United States Patent [19]

Yeomans

[11] 4,030,425

[45] June 21, 1977

[54] ARTICLE SUPPORT ASSEMBLY

[76] Inventor: David L. Yeomans, 3985 Fairmount Blvd., Cleveland Heights, Ohio 44118

[22] Filed: Mar. 4, 1976

[21] Appl. No.: 663,997

[52] U.S. Cl. ..... 108/111; 211/181; 211/182; 211/189; 211/194

[51] Int. Cl.[2] ..... A47B 3/00

[58] Field of Search ..... 108/111; 211/126, 181, 211/182, 189, 194, 206; 312/108, 111, 257 SK, 257 M

[56] References Cited

UNITED STATES PATENTS

| | | | |
|---|---|---|---|
| 1,355,486 | 10/1920 | Longenecker | 211/126 |
| 1,893,755 | 1/1933 | Wentworth | 211/133 |
| 1,957,153 | 5/1934 | Smiley | 211/126 |
| 2,239,483 | 4/1941 | Cocks | 211/126 |
| 2,569,555 | 10/1951 | Chanslor et al. | 108/111 X |
| 2,615,771 | 10/1952 | Curtis | 108/111 X |
| 2,654,487 | 10/1953 | Degener | 211/182 X |
| 2,738,833 | 3/1956 | Wineman | 211/182 X |
| 2,830,825 | 4/1958 | Webber et al. | 108/111 X |
| 2,913,128 | 11/1959 | Milner | 108/111 |
| 2,916,161 | 12/1959 | Schaefer | 211/126 |
| 3,202,295 | 8/1965 | Drader | 211/126 |
| 3,487,951 | 1/1970 | Beltzung | 211/181 X |
| 3,788,242 | 1/1974 | Hassel et al. | 108/111 |

*Primary Examiner*—James C. Mitchell

[57] ABSTRACT

An article support assembly for supporting articles of merchandise on a flat surface (e.g. desk tops, table tops, floors, etc.) in an orderly, readily accessible condition. A basic article supporting structure includes a series of spaced apart parallel shelves, each being formed by a plurality of interconnected rod elements defining a substantially open gridwork. A series of side pieces are disposed between the shelves, and serve to interconnect the open gridworks and to resist dislodging of the articles which rest on the shelves. In one feature of the invention the side pieces are formed as elongated panels associated with common edge portions of the gridworks. Each of the side panels has a longitudinal extent which is substantially as great as the associated edge portions of the gridworks. Connector means serve to interconnect the side panels with the associated gridworks and hold the panels and associated gridworks against relative movement. In another feature of the present invention a plurality of pairs of connecting pins are fixedly connected to common locations on the various gridworks. Each pin is oriented perpendicular to the plane of its associated gridwork and extends both above and below the plane of the gridwork. The side pieces each include a pair of channels which have first end portions engaging a pair of pins which extend downwardly from the plane of one gridwork and second end portions which engage a pair of pins extending upwardly from the plane of another gridwork. Means are provided for fixedly connecting the first end portion of one of the pair of channel members with the second end portion of the other of the channel members and for fixedly connecting the first end portion of the other channel member with the second end portion of the first channel member.

11 Claims, 5 Drawing Figures

FIG.2
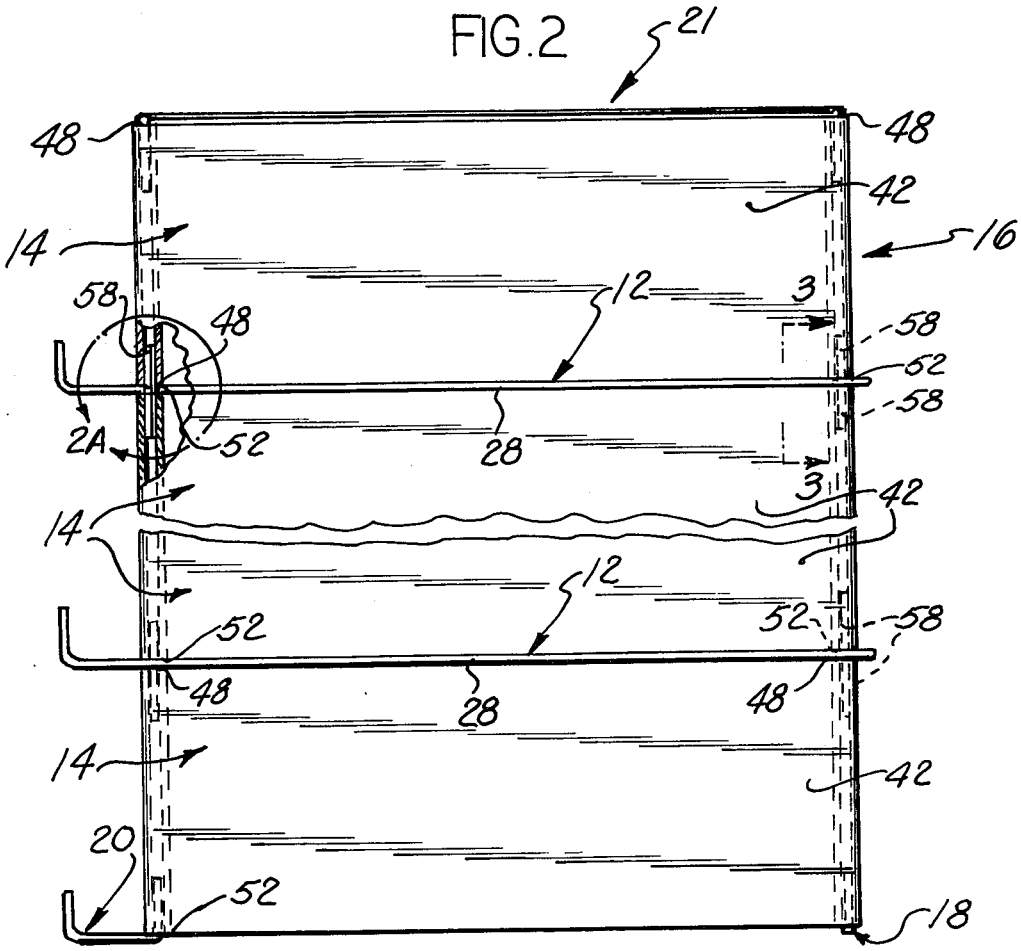
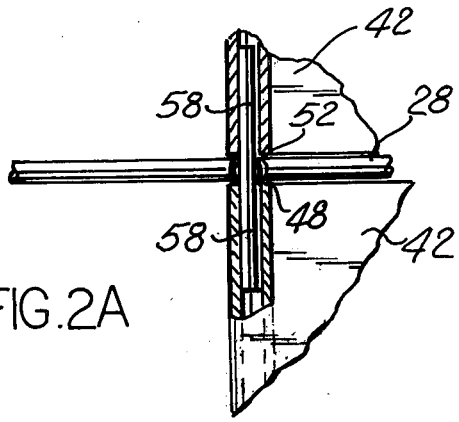
FIG.2A
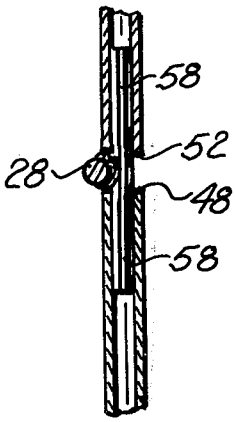
FIG.3

ARTICLE SUPPORT ASSEMBLY

BACKGROUND OF THE INVENTION

This application relates generally to a support assembly for supporting articles in an orderly and yet easily accessible relationship. The present invention relates particularly to an article support assembly which may be readily built up to a desired height, and which can also be readily dissembled or knocked down when not in use to facilitate storage or shipping of the assembly.

There are numerous types of article support facilities in which a number of articles are loosely supported, and sometimes stacked, on large open shelving units. A typical example exists in automobile part storage centers. Large shelving units in which the shelves are typically spaced apart by 12, 18 or 24 inches generally support many different types of automobile parts in a manner which is intended to make them readily accessible to a merchant. Small, unpackaged, parts are often loosely supported on the shelving units. Packages of articles, such as automobile light bulb cases are generally stacked on the shelving units. Applicant has found that there is an existing need for article support assemblies which can support various articles in a compact, orderly and readily accessible condition on such shelving units, which are easy to assemble and disassemble, which are stable when built-up to various heights, and which are inexpensive to manufacture.

SUMMARY OF THE INVENTION

The article support assembly according to the invention satisfies all of the foregoing criteria. It can be readily assembled in various heights and may be readily disassembled when not in use. It has extremely good resistance to "racking" (the tendency of a vertically extending article support structure to bend, deform or tip under its own weight, and the weight of its burden). An article support assembly according to the invention can be substantially constructed out of two basic types of elements which are interconnectable to form the assembly. At the same time an assembly according to the invention is inexpensive to produce, thus making it attractive from a commercial point of view.

The present invention provides a novel article support assembly which is particularly desirable for supporting articles of merchandise in an orderly, readily accessible condition on large shelving units, in effect subdividing the large shelving units. At the same time, the article support assembly according to the present invention has a considerably more universal appeal in that it can function to support (and display) articles of merchandise on virtually any flat surface (e.g. desk tops, table tops, floors, etc.) in an orderly, readily accessible condition.

The present invention provides a basic article supporting structure in the nature of a series of spaced apart parallel shelves, each being formed by a plurality of interconnected rod elements defining a substantially open gridwork. A series of side pieces are disposed between the shelves, and serve to interconnect the open gridworks and to resist dislodging of the articles which rest on the shelves.

In one feature of the invention the side pieces are formed as elongated panels associated with common edge portions of the gridworks. Each of the side panels has a longitudinal extent which is substantially as great as the associated edge portions of the gridworks. Connector means serve to interconnect the side panels with the associated gridworks and hold the panels and associated gridworks against relative movement.

In another feature of the present invention a plurality of pairs of connecting pins are fixedly connected to common locations on the various gridworks. Each pin is oriented perpendicular to the plane of its associated gridwork and extends both above and below the plane of the gridwork. The side pieces each include a pair of channels which have first end portions engaging a pair of pins which extend downwardly from the plane of one gridwork and second end portions which engage a pair of pins extending upwardly from the plane of another gridwork. Means are provided for fixedly connecting the first end portion of one of the pair of channel members with the second end portion of the other of the channel members and for fixedly connecting the first end portion of the other channel member with the second end portion of the first channel member.

BRIEF DESCRIPTION OF THE DRAWINGS

The further features and advantages of the present invention will become further apparent from the following detailed description taken with reference to the accompanying drawings wherein:

FIG. 2 is a side view of the article support assembly of FIG. 1, taken from the direction 2—2;

FIG. 2A is an enlarged view of the area of FIG. 2 labeled 2A;

FIG. 3 is sectional view of the portion of FIG. 2 labeled 3—3;

DETAILED DESCRIPTION OF THE PREFERRED EMBODIMENT

Figure 1:
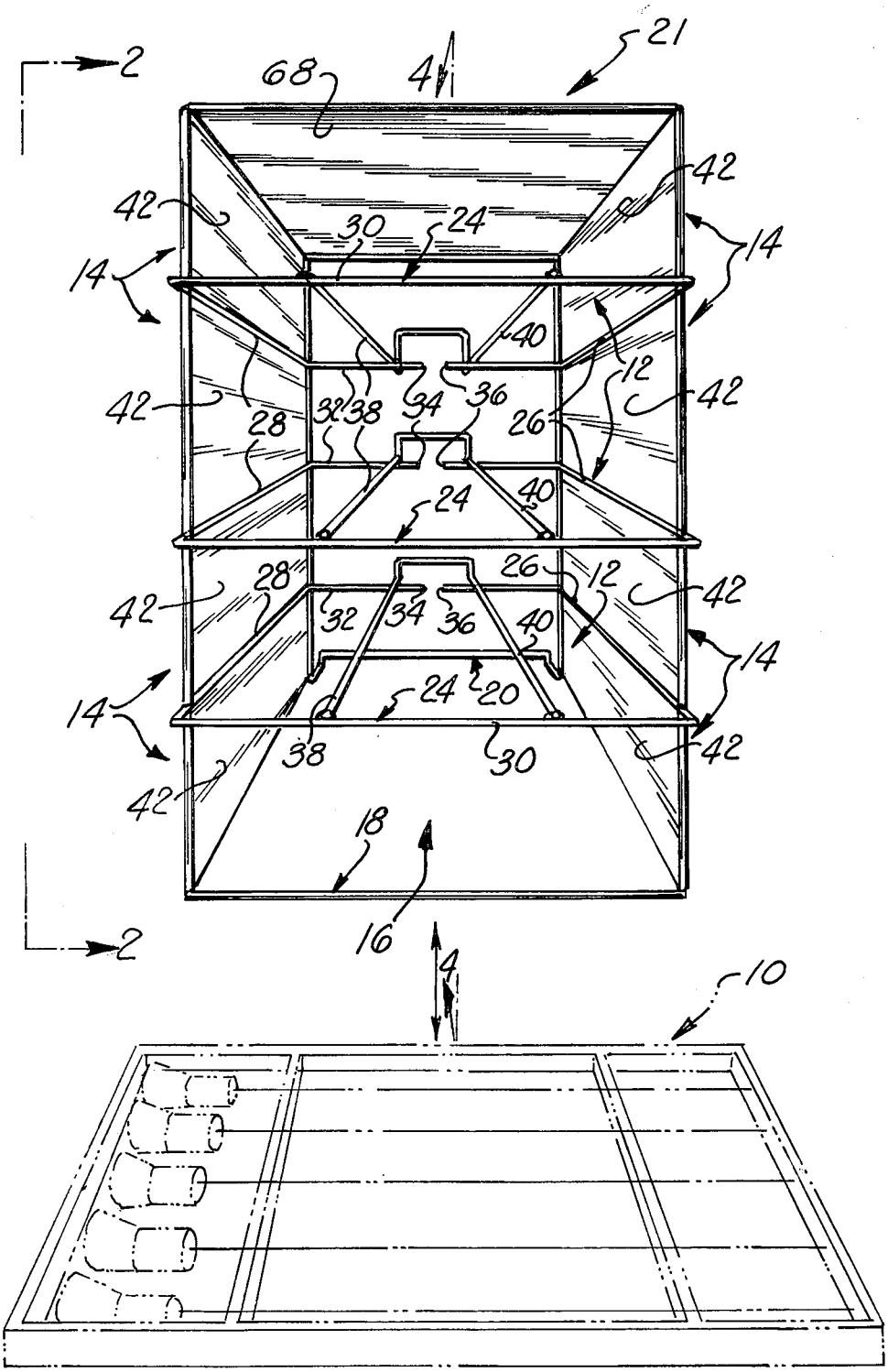
FIG. 1 is a front perspective view of an article support assembly according to the present invention.

FIG. 1 illustrates an article support assembly according to the present invention in assembled condition. The preferred form of the article support assembly of FIG. 1 is dimensioned to receive and support a series of packaged articles of merchandise such as automobile light bulb cases 10. However, from the description which follows the manner in which the present invention can be used to support numerous other types of articles will be readily apparent to those of ordinary skill in the art.

Referring to the drawings, the article support assembly includes a set of shelves 12 upon which articles of merchandise, such as automobile light bulb cases 10, rest. Each shelf 12 is formed as a substantially flat rectangular open gridwork in a manner set forth in detail hereinafter. The gridworks are supported in spaced apart parallel relationship by means of a plurality of side pieces 14. The front end 16 of the support assembly is open thereby providing readily accessibility to the supported articles. At the same time, the side pieces 14 serve to resist dislodging of the articles in directions sidewise to the front opening 16. Rod members 18, 20 engage the lowermost side pieces for supporting the entire structure. Top member 21 engages the topmost side pieces and provides a top cover for the article support assembly. While in the illustrated embodiment three gridworks are shown, it will be recognized that using the principles of the present invention various numbers of gridworks can be similarly supported.

Figure 4:
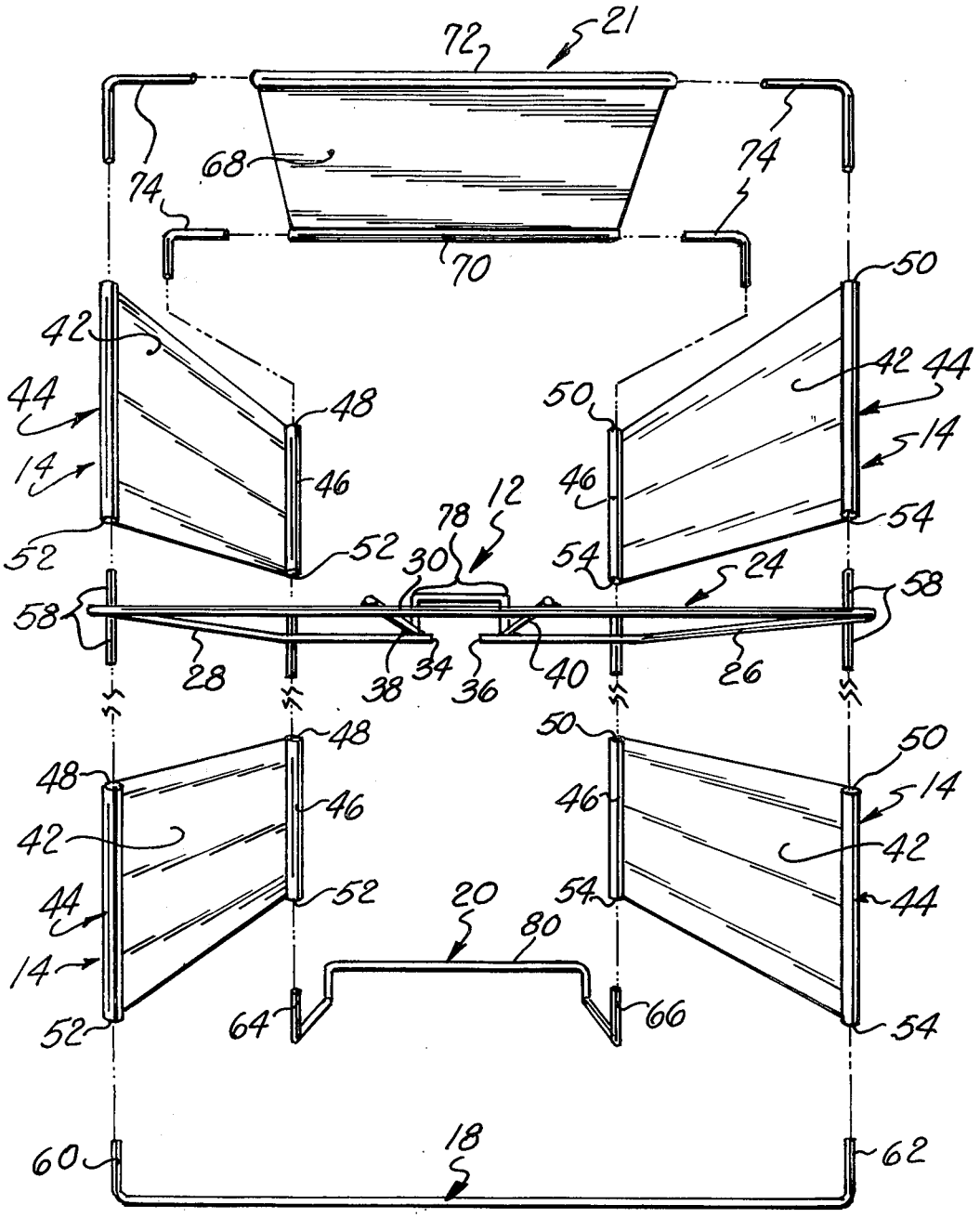
FIG. 4 is an exploded perspective view of an article support assembly according to the present invention.

The preferred construction of each of the gridworks may be appreciated by reference to FIGS. 1, 4. Each gridwork is an open, flat rectangular structure formed by a plurality of interconnected metal rod elements. In the illustrated embodiment each gridwork comprises a single metal rod element 24 bent to form a first set of parallel edge portions 26, 28 and a second pair of parallel edge portions 30, 32. The edge portion 32 is formed with a pair of aligned ends 34, 36 having a small gap between them. However, it is also contemplated that the ends 34, 36 may be welded, or otherwise joined to each other. Whether or not it is necessary to join the ends 34, 36 depends primarily upon whether the merchandise which is to be supported on the gridworks requires sufficient structural support to necessitate joining the ends. To complete the gridwork a pair of metal rod members 38, 40 are welded to the edge portions 30, 32, and extend generally parallel to edge portions 26, 28. The rod members 38, 40 form cross-pieces in the gridworks.

The totality of the edge portions 26, 28, the edge portions 30, 32, and the cross-pieces 38, 40 thus form a substantially rectangular open gridwork upon which articles such as a light bulb 10 case can rest. It should be noted that the totality of the edge portions 26, 28, the edge portions 30, 32, and the cross-pieces 38, 40 also form the plane of the gridwork, even though the cross-pieces 38, 40 may be disposed slightly above the upper most surfaces of the edge portions. The plane of the gridwork is basically the plane upon which the articles rest.

The side pieces 14 are disposed between the gridworks. As shown in the figures each side piece is in the form of a longitudinally extending side panel 42. Connector means, described more fully hereinafter, serve to interconnect the side panels 42 with the associated gridworks and hold the side panels and associated gridworks against relative movement.

In one feature of the invention the panels 42 have a longitudinal extent which is substantially as great as the extent of the associated outer edge portions of the gridworks. This means that the longitudinal extent of each side piece is greater that 50% of the extent of the outer edge portions of the associated gridworks, and as seen in the figures the side pieces preferably extend almost to the corners of the associated gridworks.

The structural stability of the support assembly, and particularly its resistance to racking is particularly enhanced by side panels whose longitudinal extent is greater than 50% of the extent of the outer edge portions of the associated gridworks and which preferably extends as close to the corners of the gridworks as possible.

In another feature of the invention each of the side pieces includes a pair of substantially parallel channels disposed with first end portions adjacent the outer edge portions of one associated gridwork and second end portions adjacent the outer edge portion of another associated gridwork. The first end portion of each channel is substantially rigidly connected to the second end portion of the other channel.

According to the preferred embodiment the side pieces 14 are formed as substantially flat rectangular pieces of sheet metal having their longitudinal ends bent into the shape of channels 44, 46. The disposition of the side pieces is such that first end portions 48, 50 of the channels are disposed adjacent the edge portion 26, 28 of one gridwork while second end portions 52, 54 of the channels are disposed adjacent the edge portions 26, 28 of another gridwork. The remaining portion of the piece of sheet metal serves to fixedly connect the first end portion of each cnannel to the second end portion of the other channel. While the formation of the side pieces of sheet metal with bent ends is preferred it is contemplated that it may be possible to achieve similar structural results with other types of side pieces having a pair of parallel channels whose end portions are interconnected with each other in the manner set forth above.

Further according to the invention a plurality of connector means are disposed adjacent to the common edge portion of each of the gridworks and are adapted for connecting the common side portions of the gridworks with associated side pieces to hold the girdworks and side pieces against relative movement. According to the preferred embodiment the connecting means are formed as longitudinally extending pin members 58 fixedly connected to the edge portions of the gridworks. In the preferred embodiment the pin members 58 are welded to the edge portions of the gridworks. However, it is contemplated that there may be other comparable ways fixedly connecting the pin members to the gridworks to practice the invention.

Each pin member 58 preferably extends perpendicular to the plane of its associated gridwork and extends both above and below the plane of the gridwork, as shown in FIG. 4. A pair of pin members 58 are connected to edge portions 26, 28 of the gridworks and a pair of pin members are spaced part by a distance corresponding to the spacing between the channels of the associated side pieces. The pin members 58 which extend downwardly from one gridwork are disposed in the respective first end portions 48, 50 of the channels of an associated side piece, and the pin members which extend upwardly of an adjacent gridwork are disposed in the respective second end portions 52, 54 of the channels of the side piece.

The engagement of the pins with the respective channels prevents relative horizontal movement of the parts of the assembly. Additionally, the channels are formed with inner peripheries which are just slightly greater than the outer peripheries of the pin members 58 (see particularly FIGS. 2A, 3), so that when they are connected, the channels and pin members frictionally engage each other to prevent relative vertical movement between the gridworks and the side pieces. Also, as shown in FIGS. 1, 2 the pin members 58 can extend far enough into their respective channels so that the end portions of the channels abut the surfaces of the edge portions of the associated gridworks.

A pair of rod members 18, 20 are provided for supporting the entire assembly. In the disclosed embodiment a first U-shaped rod element 18 includes a pair of parallel leg portions 60, 62 each of which engages a respective channel of one of the lowermost side pieces 14. A second rod element 20 includes a pair of parallel leg portions 64, 66, each of which engages the respective other channel of the lowermost end pieces 14.

A top member 21 is provided and is disposed in a parallel spaced relation to the topmost gridwork. In FIGS. 1 through 5 the top member includes a substantially planar sheet of material 68 (preferably metal) having a pair of edge portions which define a pair of channels 70, 72. The channels 70, 72 are oriented so that they extend from a channel of one of the uppermost side piece. A series of L-shaped connecting pins 74 each interfit with a respective channel end in a side piece and a respective channel in the top member and serve to hold the top member and the uppermost side pieces against relative movement.

In the assembling of a support assembly according to the present invention the desired number of gridworks are interfit with their respective side pieces, the rod members 18 and 20 are connected to the lowermost side pieces and the top member is connected to the uppermost side pieces. Thus assembled, the support assembly can rest on virtually any flat surface to support articles in a readily accessible condition. The structure can be totally or partially disassembled, and then assembled in a different height to provide either a more compact or a larger article assembly, as desired.

Additionally, the gridworks and the lower rod members can be easily designed with rear supports for the merchandise. In the embodiment of FIG. 4 the cross-pieces forming each gridwork have upturned portions 78 forming an inverted U, and the rearmost rod member 20 also includes a portion 80 turned upwardly and forming a inverted U. This provides a form of a backstop when an article such as the light bulb case of FIG. 1 is slid into the article support assembly. It also forms a backstop in the event that some form of drawers are to be inserted on the gridworks.

In addition to its ease of assembly and disassembly, the article support assembly according to the present invention has extremely good resistance to racking. "Racking" is a term well known in the shelving art and refers to the tendency of a builtup article support structure to bend, deform or tip under its own weight and the weight of its burden. The joining of the channels in the manner set forth heretofore provides a structure which can be built up to various heights and yet provide extremely good resistance to racking.

With the foregoing disclosure in mind many and varied forms of support assemblies using the principles of the present invention will become readily apparent to those of ordinary skill in the art.

What is claimed is:

1. A support assembly comprising a plurality of flat open rectangular gridworks disposed in a spaced apart parallel relationship, each of said gridworks being formed by a plurality of interconnected rod elements, a plurality of elongated side panels each of which is associated with corresponding outer edge portions of two of said flat gridworks and extends perpendicular to said gridworks, each of panels having a longitudinal extent which is substantially as great as the extent of the associated outer edge portions of the flat rectangular gridworks, a plurality of connector means connected with and disposed adjacent to a corner portion of each of said flat rectangular gridworks, a plurality of connector means connected with and disposed adjacent to a corner portion of each of said flat rectangular gridworks for connecting said panels with the associated gridworks and for holding said side panels and associated gridworks against relative movement.

2. A support assembly as set forth in claim 1 wherein said connector means comprise a plurality of pin members fixedly connected to the outer edge portions of said gridworks, each of said side pieces comprising at least one channel portion fixedly connected to a respective side panel and adapted to receive a respective pin member for holding said gridworks and side pieces against relative movement.

3. A support assembly as set forth in claim 1 wherein said side panels are substantially shaped, and said connecting means are disposed so as to connect the longitudinal end portions of said side panels with the associated gridworks.

4. A support assembly comprising a plurality of flat, substantially rectangular open gridworks disposed in a spaced apart parallel relationship, a plurality of pairs of pins fixedly connected to common locations of corresponding edge portions of each gridworks and extending above and below the plane of each gridwork, a plurality of side pieces disposed between adjacent gridworks, each side piece comprising a pair of channel portions having first end portions for respectively engaging a pair of pins extending downwardly from the plane of one gridwork and second end portions for respectively engaging a pair of pins extending upwardly from the plane of another gridwork, means for fixedly connecting the first end portion of a first one of said pair of channel members to the second end portion of the other of said channel members and for fixedly connecting the first end portion of said other channel portion to the second end portion of said first channel member.

5. A support assembly as set forth by claim 4 wherein each side piece comprises an elongated sheet of material having a pair of end portions formed into said channel members.

6. A support assembly as set forth by claim 5 wherein each side piece is formed of a rectangular piece of sheet metal having a pair of widthwise end portions formed into said channel portions.

7. A support assembly as set forth in claim 6 wherein a pair of pins are fixedly connected to parallel sides of each gridwork with each pair of pins being spaced apart by a distance corresponding to the spacing between the pair of channels of a sidepiece.

8. A support assembly as set forth in claim 7 wherein the spacing between each pair of channels and between each associated pair of pins is substantially as great as the extent of the associated sides of the gridwork.

9. A support assembly as set forth by claim 4 wherein said plurality of gridworks are disposed in a vertically spaced apart relationship with the planes of the gridworks disposed substantially horizontally and both the pins and the channels are disposed substantially vertically, and wherein a pair of side pieces are disposed between each gridwork and an adjacent gridwork and a first pair of side pieces extend upwardly from the uppermost gridwork and a second pair of side pieces extend downwardly from the lowermost gridwork, one or more U-shaped rod members having a pair of parallel leg portions engaging the second end portions of one channel of each of said second pair of side pieces.

10. A support assembly as set forth in claim 4 wherein said gridworks are disposed in a spaced apart horizontal orientation and including a top member disposed in parallel spaced apart relationship to the uppermost one of said gridworks, at least one of said side pieces having a pair of channels engaging the portion of the pin members extending upwardly from the plane of the uppermost gridwork, and means for connecting said side pieces to said top member.

11. A support assembly as set forth in claim 10 wherein said top member includes a channel portion disposed substantially perpendicular to a channel portion of the associated side piece, and a pin member engaging the channel in said top member and the associated channel in said side piece.

* * * * *

UNITED STATES PATENT AND TRADEMARK OFFICE

CERTIFICATE OF CORRECTION

PATENT NO. : 4,030,425
DATED : June 21, 1977
INVENTOR(S) : David L. Yeomans

It is certified that error appears in the above-identified patent and that said Letters Patent are hereby corrected as shown below:

Column 5, line 68, after "substantially" add --rectangularly--.

Signed and Sealed this

*First* Day of *November 1977*

[SEAL]

*Attest:*

RUTH C. MASON
*Attesting Officer*

LUTRELLE F. PARKER
*Acting Commissioner of Patents and Trademarks*